United States Patent [19]

Stunzi

[11] Patent Number: 4,504,811

[45] Date of Patent: Mar. 12, 1985

[54] CABLE OPERATED TAP CHANGER FOR A THREE-PHASE TRANSFORMER

[75] Inventor: Joseph M. Stunzi, Athens, Ga.

[73] Assignee: Westinghouse Electric Corp., Pittsburgh, Pa.

[21] Appl. No.: 441,134

[22] Filed: Nov. 12, 1982

[51] Int. Cl.[3] ..... H01F 33/00

[52] U.S. Cl. ..... 336/10; 200/11 TC; 200/16 C; 200/16 F; 336/150

[58] Field of Search ..... 336/5, 10, 12, 150; 200/11 TC, 161, 16 F, 16 C, 17 R, 18; 323/340, 323/341, 342, 343

[56] References Cited

U.S. PATENT DOCUMENTS 3,673,364 6/1972 Klein ..... 200/16 F X
3,824,355 7/1974 Normen et al. ..... 200/16 F
3,875,354 4/1975 Dusek ..... 200/11 TC
4,013,847 3/1977 Guidosh ..... 200/11 TC X

*Primary Examiner*—Thomas J. Kozma
*Attorney, Agent, or Firm*—L. P. Johns

[57] ABSTRACT

A three-phase transformer including tap changing apparatus for switching the turns ratio between the primary and secondary windings of a transformer. The tap changer comprises a cable operated mechanism for moving a movable contact carrier relative to three sets of fixed contacts disposed in a linear pattern, the movable contact carrier supporting three movable contacts for engagement with any pair of fixed contacts in each set of contacts, whereby a cable operated mechanism provides a high degree of flexibility in switch mounting position on a transformer.

6 Claims, 10 Drawing Figures

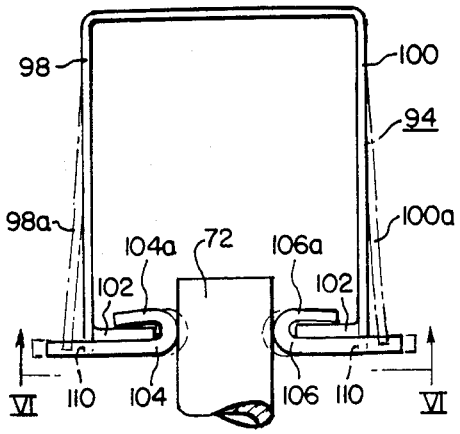
FIG.5.
FIG.10.
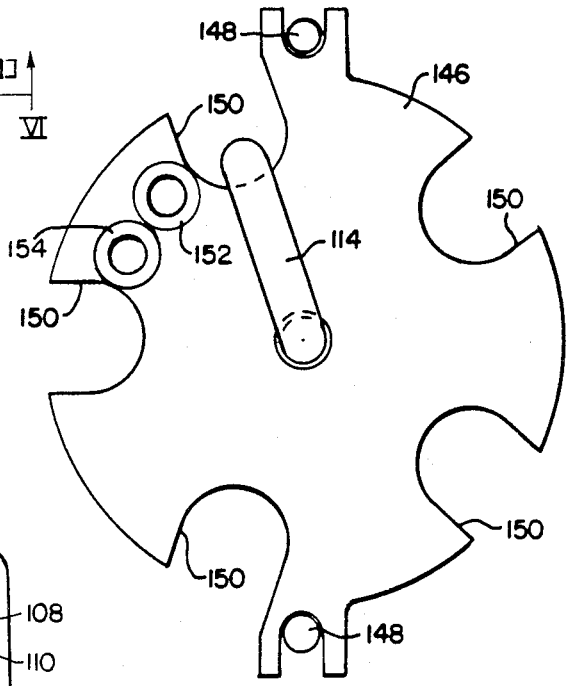
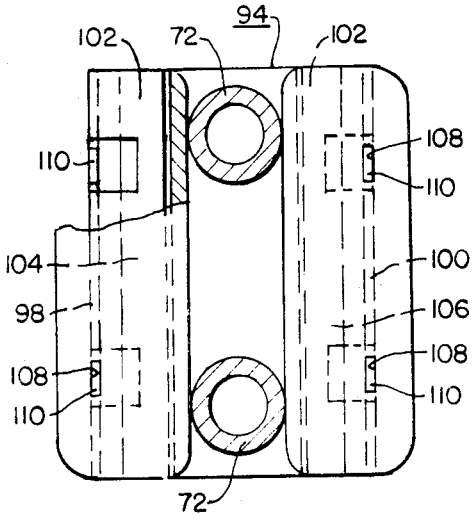
FIG.6.
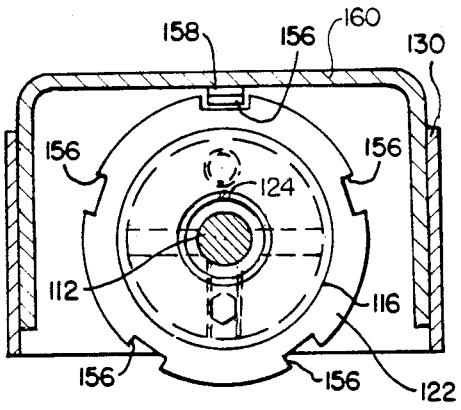
FIG.9.

CABLE OPERATED TAP CHANGER FOR A THREE-PHASE TRANSFORMER

BACKGROUND OF THE INVENTION

1. Field of the Invention:

This invention relates in general to electrical inductive apparatus and, more particularly to a three-phase electrical transformer utilizing a cable driven mechanism.

2. Description of the Prior Art:

Tap changing has been used in various types of electrical inductive apparatus and is usually provided for power transformers to enable the output voltage of the transformer to be maintained substantially constant under varying load conditions, or to enable the output voltage to be varied. Usually the tappings are on either the primary or the secondary side of the transformer, and the tap changing mechanism is arranged so that tappings may be changed without disconnecting a load.

No-load tap changers provide a range of output voltages for transformer. Usually the transformers include a series of connections or taps from various sections of either the primary or secondary winding, whereby a different number of winding turns are employed at each tap. Conventional no-load tap changers, which operate when the transformer is deenergized, include a plurality of stationary contacts, each connected to a different tap on the winding, and a contact assembly which can be moved to engage any one of the stationary contacts, thereby altering the turns ratio between the primary and secondary windings and altering the output voltage of the transformer.

For three-phase transformers such tap changers have separate sets of stationary and movable contacts for each phase of the transformer. The movable contacts are usually connected together by a common drive means causing them to rotate together. Although satisfactory, such tap changers require detailed coupling mechanisms to alter the tap settings. The connecting members are necessarily large and rigid to ensure proper alignment of gear drive trains and to withstand large forces required to switch all three phases of the tap changer simultaneously. Such construction increases the size and weight of the transformer, because no-load tap changers are usually mounted inside the transformer enclosure. Accordingly, there is a need for a no-lead tap changer mounted inside the transformer enclosure which is smaller and more economical than the no-load tap changers of prior structures.

SUMMARY OF THE INVENTION

The three-phase electrical transformer using a no-load tap changer of this invention comprises an enclosure containing primary and secondary windings in inductive relation with a three-phase magnetic core with the windings in each phase having tapped winding sections with tap leads connected thereto for providing different voltages. Tap changing means are provided which include a fixed contact for each tap lead with the fixed contacts for each winding section being disposed at spaced intervals in a group of fixed contacts. The tap changing means also includes a movable contact carrier having a movable contact for each group of fixed contacts and the movable contacts for each group extending between adjacent pairs of spaced fixed contacts. The movable contact carrier comprises an elongated member movable longitudinally between the positions of the movable contacts. Means for moving the movable contact carrier are also provided which comprise a handle, a pair of cables, and a spool rotated by the handle and on which one end of each cable is mounted in opposite directions with the other end of each cable extending to the elongated movable contact carrier for moving the same in opposite directions, whereby the movable contacts are shifted between different pairs of fixed contacts for providing different voltages.

The advantage of the device of this invention is that it provides for a high degree of flexibility in switching.

BRIEF DESCRIPTION OF THE DRAWINGS

FIG. 5 is an enlarged end view of a movable contact showing the flexed side walls and the fixed contact position;

FIG. 6 is a plan view taken on the VI—VI of FIG. 5;

FIG. 9 is a vertical sectional view taken on the line IX—IX of FIG. 8; and FIG. 10 is an elevational view of the handle and index plate assembly.

DESCRIPTION OF THE PREFERRED EMBODIMENT

Figure 1:
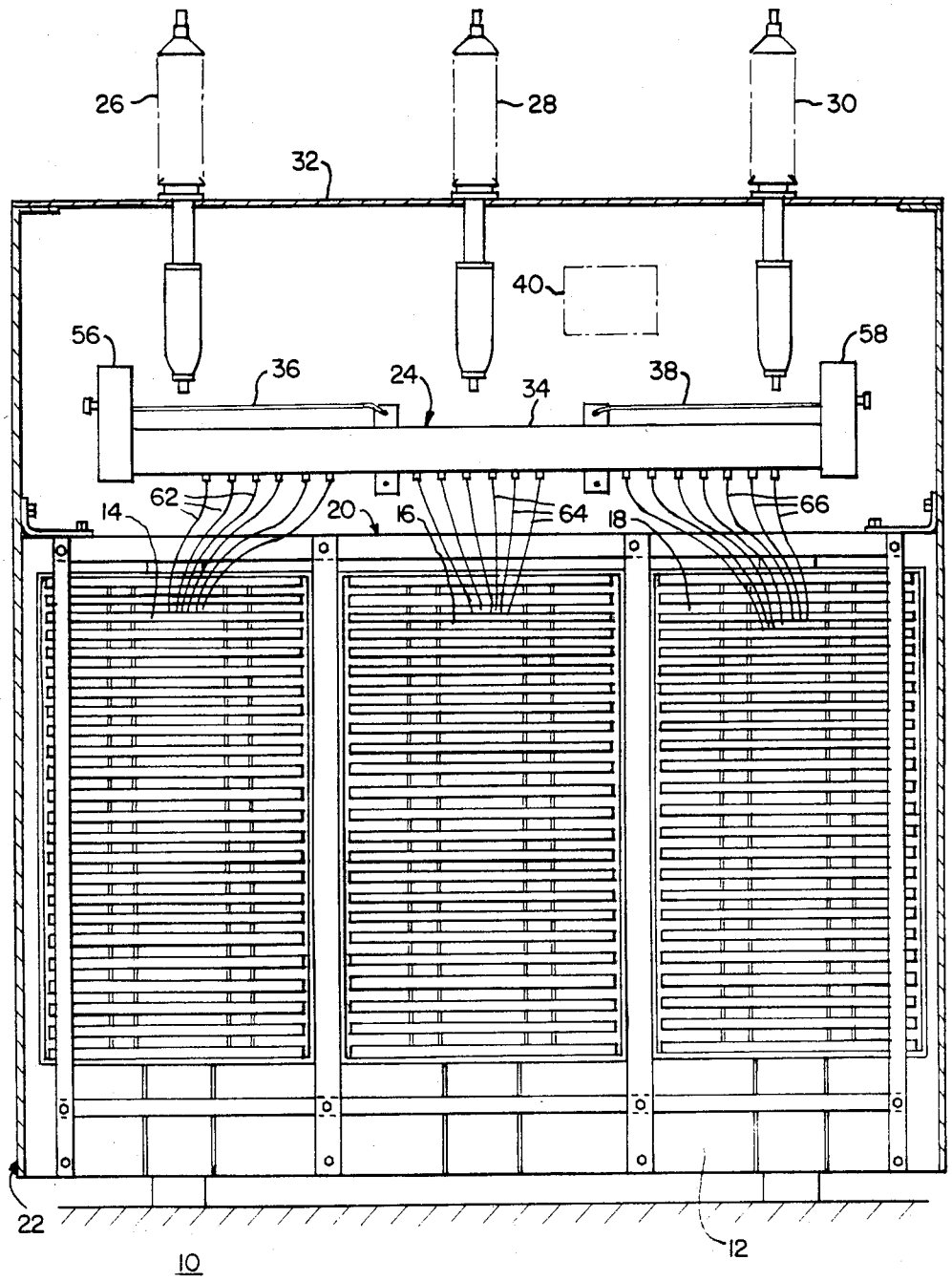
FIG. 1 is a vertical sectional view of a three phase transformer having a no-load tap changer mounted within the transformer tank.

In FIG. 1 a three-phase transformer is generally indicated at 10 and it consists of a magnetic core and coil assembly 12 in which phase windings 14, 16, 18 are disposed in inductive relation with a three-phase magnetic core 20. The core and coil assembly 12 has a cubical form wherein the sides form vertical planar, exterior surfaces, and the top and bottom form horizontal, planar and exterior surfaces. The sealed case or enclosure 22 surrounds the assembly 12. A tap changer 24 is also contained within the case 22. Bushings 26, 28, 30, which are normally connected to electric leads (not shown), extend through the top surface 32.

Figure 3:
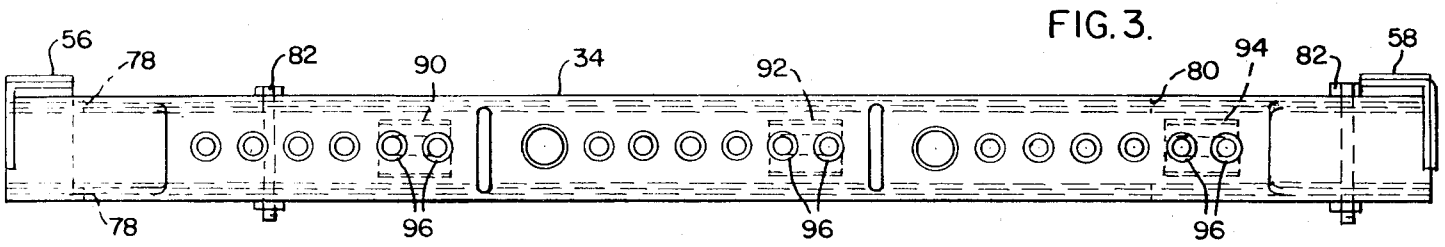
FIG. 3 is a plan view of the mechanism.
Figure 4:
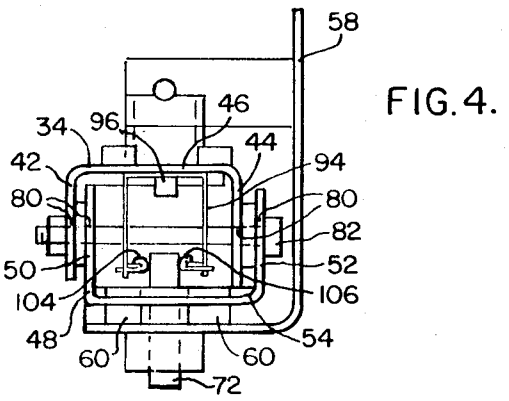
FIG. 4 is an end view of tap changer mechanism taken on the line IV—IV of FIG. 2.

The tap changer 24 comprises an elongated member or movable contact carrier 34, a pair of cables 36, 38, and a manual control unit or handle 40. As shown more particularly in FIGS. 2–5, the movable contact carrier 34 is a channel member having opposite side walls 42, 44, and intermediate or bight wall 46, and an open side opposite the bight wall (FIG. 4). The movable contact carrier 34 is mounted on a fixed support member or channel 48 having opposite side walls 50, 52, and a bight wall 54 from which the side walls extend upwardly. The bight wall 54 is mounted on spaced brackets 56, 58 (FIG. 3) by suitable means, such as pop rivets 60. The mounting brackets 56, 58 in turn are secured to a suitable support frame (not shown) within the enclosure 22 and preferably above the phase windings 14, 16, 18. The movable contact carrier 34 and the support channel 43 are mounted channels of a dielectric thermal plastic material such as a combination of glass fiber and polyester resin.

Figure 2:
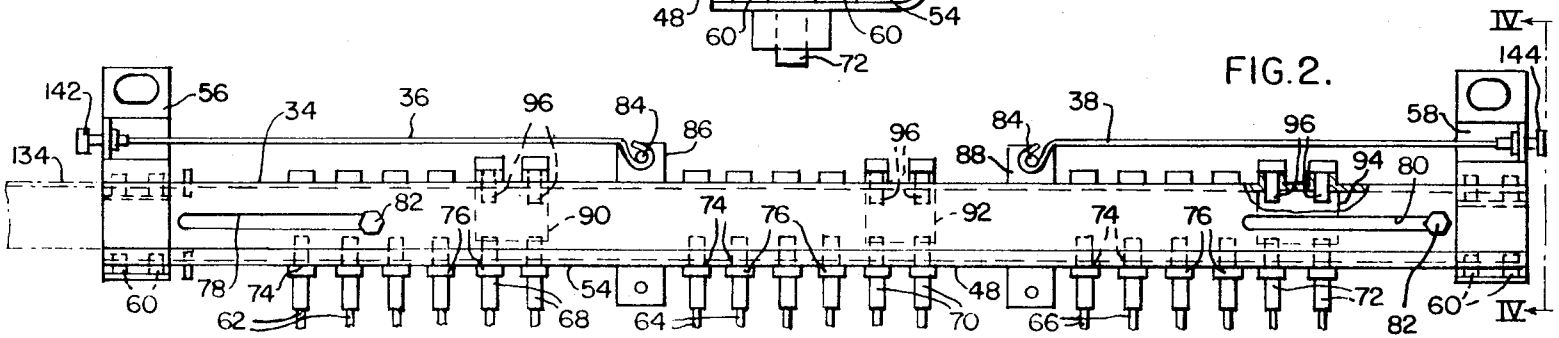
FIG. 2 is an elevational view of the tap changer drive mechanism.
Figure 7:
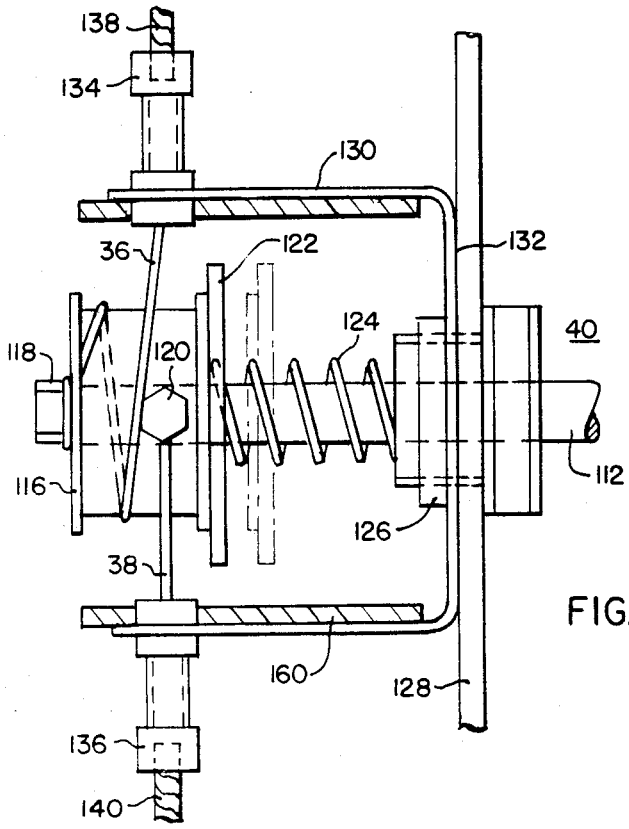
FIG. 7 is a plan view of the tap changer drive mechanism.

As shown in FIG. 1 a series of tap leads 62, 64, 66 extend out of the various sections of each transformer phase winding 14, 16, 18, respectively, and are connected to appropriate stationary contacts 68, 70, 72, respectively (FIG. 2). The stationary contacts are preferably comprised of a metal such as copper and are separately secured in spaced relation within the bight wall 54 of the channel 48. For that purpose the channel 48 includes spaced sets of holes 74 and molded reinforcing collars 76 in which the stationary contacts or studs 68 are imbedded. Upper end portions of each stationary contacts 68 extend above the bight wall 54 of the channel 48.

The movable contact carrier 34 (FIGS. 2, 3, 4) and the channel 48 are composed of aligned slots 78, 80 on opposite side walls of each member and similar mounting bolts 82 extend through the aligned slots to enable sliding or longitudinal movement of the movable contact carrier with respect to the lower channel 48. The cable 36 (FIG. 2) is attached to a mounting pin 84 within a tubular projection 86 extending from the upper bight wall 46 of the carrier. Likewise, the cable 38 is attached to a similar pin 84 extending through a projection 88 on the upper bight wall 46 of the carrier 34. Accordingly, the movable contact carrier 34 may be moved longitudinally to the left broken line position 134 by the cable 36 to a distance equal to the length of the slots 78, 80.

As shown in FIG. 2 three movable contacts 90, 92, 94 are mounted on the bight wall 46 of the movable contact carrier 34 by similar pins 96. The particular contact 94 (FIG. 5), which is typical of all the movable contacts, is an inverted U-shaped member having opposite side walls 98, 100. The contact is comprised of a spring sheet metal stock to enable outward flexing of the side walls 98, 100 to provide good electrical contact with the stationary contacts 68, 70, 72. More particularly, the lower ends of the side walls 98, 100 have inturned tabs 102 each of which supports a bridging contact 104, 106 (FIGS. 5, 6). Each bridging contact 104, 106 is formed metal having an inner end portion 104*a*, 106*a* having a 180 degree bend for contact with opposite sides of a pair of stationary contacts 72 (FIG. 6). The bent portions 104*a*, 106*a* are formed around the inner edge of similar tabs 102. The remainder of the bridging contacts 104, 106 extend along the under surfaces of the inturned tabs 102 and through similar notches 108 at the lower ends of the side walls 98, 100 and include out-turned projections 110. The combination of the several parts 102, 104*a*, 106*a*, 104, 106, 108, and 110 combine to retain the bridging contacts 104, 106 in place at the lower end of the side walls 98, 100. Moreover, the bridging contacts 104, 106 are comprised of a metal having a high coefficient of electrical conductivity, such as copper, and are all heavy gage stock to enable the conduction of current between adjacent stationary contacts 72 (FIG. 6). Inasmuch as the diameter of the stationary contacts 72 is slightly greater than the distance between the bent portions 104*a*, 106*a*, the lower end portions 98*a*, 100*a* are flexed outwardly to hold the contacts in good electrical contact with the stationary contacts 72.

In accordance with this invention the tap changer 24 also includes the manual control unit or handle 40 (FIGS. 7, 8, 9, 10) for operating the cable 36, 38. The handle 112 is an elongated shaft having an external U-shaped portion 114 and a internal end portion on which a reel or spool 116 is fixedly mounted. End portions of the cables 36 and 38 are wound on the spool 116 in opposite directions where they are secured in place such as by fastening bolts 118, 120. A stop plate 122 is fixedly mounted on one side of the spool 116 and a coil spring 124 is disposed between the stop plate and a bushing 126 by which the shaft of the handle 112 is mounted in a wall 128 of the transformer enclosure.

A U-shaped mounting 130 is fixedly mounted at 132 of the wall 128. Similar cable adjustment bolts 134, 136 are mounted on opposite sides of the U-shaped bracket 130 by which the cable 36, 38, respectively, are tightened in place between the reel 116 and the pins 84, (FIG. 2). For that purpose each cable 36, 38 is enclosed within a cable mesh 138, 140 the ends of which are secured to the adjustment bolts 134, 136 (FIG. 7), and the other ends of which are secured to similar adjustment bolts 142, 144, respectively (FIG. 2). Thus the cables 36, 38 are retained in tight condition between their respective ends so that rotation of the spool in either direction causes precise movement of the movable contacts 90, 92, 94 between the desired pairs of contacts 68, 70, 72.

As shown in FIG. 2 there are 18 studs for fixed contacts including 6 contacts 68, 70, and 72 for each phase. The voltage is changed by moving the movable contacts 90, 92, 94 between the desired pairs of spaced adjacent contacts such as the contacts 72. If, for example, each fixed contact 72 is 2½ percent of a total voltage of 1400 volts the total voltage change from end to the other of the five pairs of positions is 140 volts.

Figure 8:
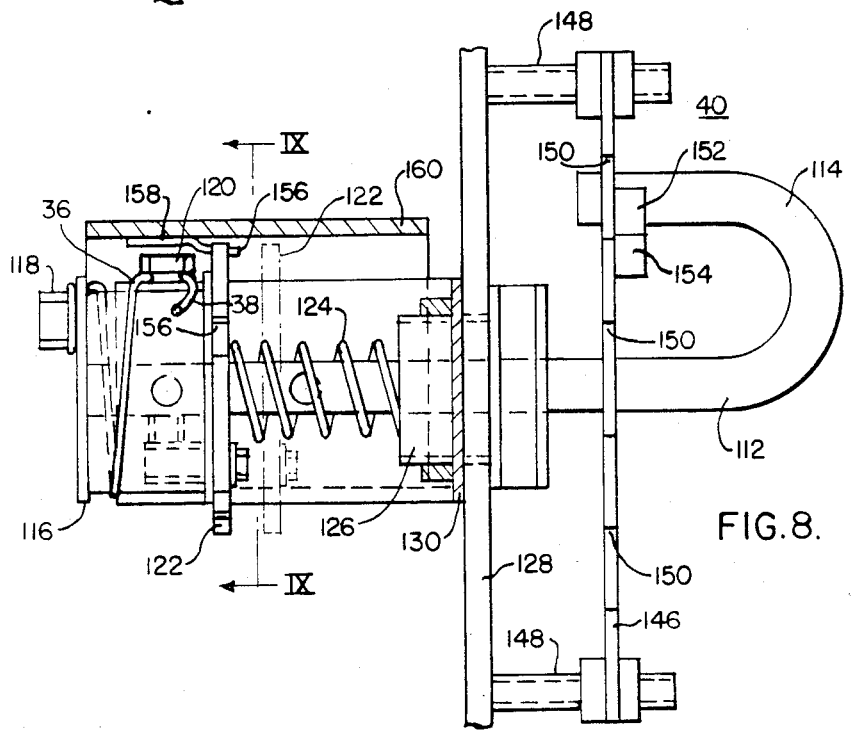
FIG. 8 is an elevation view of the drive mechanism shown in FIG. 7.

As shown in FIGS. 8 and 10 a dial plate 146 is mounted on the tank wall 128 on a pair of mounting bolts 148. The plate 146 includes five spaced peripheral notches 150, one for each of the five positions of the pairs of studs or fixed contacts 68, 70, and 72. The U-shaped handle portion 114 is retained in a selected position with the end lodged in one of the notches 150 by the pressure of the spring 124 against the stop plate 122. To change the position of the handle 112 it is manually pulled outwardly to the right as viewed in FIG. 8 against the pressure of the spring 120 to the broken line position of the plate 122 whereupon the handle 112 is rotated to any other desired notch position and released whereupon the spring 124 returns the handle to the left and into the selected notch 150. As a result the cables 36, 38 are wound and unwound upon the reel which in turn moves the several movable contacts 90, 92, 94 simultaneously to the desired pair of fixed contacts 68, 70, 72 respectively.

As shown in FIG. 10 a pair of stop blocks 152, 154 are provided on the face of the dial plate 146 to prevent inadvertent rotation of the handle too far either counterclockwise or clockwise. Thus, when the U-shaped handle 114 is pulled out of position one of the notch 150 the stop clock 152 prevents further counterclockwise rotation of the handle. Likewise the stop block 154 prevents rotation of the handle beyond position five of the notches 150.

As shown in FIGS. 8 and 9, the stop plate 122 comprises five spaced peripheral slots 156 and a key 158 is fixedly disposed in position on a U-shaped mounting bracket 160. As the handle is moved to the right against the pressure of the spring 124 (FIG. 8) the particular slot 156 is moved away from the key 158 to enable rotation of the handle 112. Accordingly, the slots and key mechanism serves as a main means for keying the position of the real 116 with the cables 36, 38.

In conclusion, the tap changer of this invention incorporates a cable operated mechanism having several advantages including mounting of the manual control switch on the top of a frame near the coil instead of in more remote position as in prior art structures. This in turn reduces the tank width and uses less material and cooling oil. Moreover, the lead length from the switch to the coil is reduced. In addition, since the manual control mechanism is no longer mounted near the high voltage bushings, clearance of these components is no longer a problem. Furthermore, the control mechanism can be placed anywhere on the front panel of the transformer. Finally, the U-shaped movable contacts are mounted in floating positions which facilitate alignment of the movable contacts with the stationary contacts notwithstanding rough tolerances built into the associated parts.

What is claimed is:

1. An electrical transformer comprising:

an enclosure;

primary and secondary windings in inductive relation with a three-phase magnetic core disposed within the enclosure;

one of the windings in each phase of the transformer having tapped winding sections with tap leads connected thereto for providing different voltages;

tap-changing means including a fixed contact for each tap lead, the fixed contacts for each winding section being disposed in groups and at spaced intervals;

the tap-changing means also including a movable contact carrier having a movable contact for each group of fixed contact;

the movable contact for each group extending between adjacent pairs of spaced fixed contacts;

means for moving the movable contact carrier to effect movement of the movable contacts between different pairs of stationary contacts and including a handle and cable means extending between the handle and the carrier;

the movable contact carrier indlucing an elongated member movable longitudinally between the positions of the movable contacts and including flexible metal parts movable into and out of biased contact with the stationary contacts; and the cable means having a pair of cables and a spool, one end of each cable being mounted on the spool, and the other end of each cable being secured to said carrier.

2. The device of claim 1 in which the diameter of the spool is a function of the distance of movement of said carrier.

3. The device of claim 2 in which the elongated member comprises a channel having opposite side walls, a bight surface, and an open side facing the fixed contacts.

4. The device of claim 3 in which the flexible metal parts of each movable contacts comprises a first channel having an open end facing the fixed contacts, and having opposite side means flexed inwardly to clampingly engage the fixed contacts.

5. The device of claim 4 in which there are mounting means for the fixed contacts including an elongated second channel having opposite sides disposed in sliding proximity with corresponding sides of the first channel, and the fixed contacts being secured in place in a bight side of the second channel.

6. The device of claim 2 in which one cable winds onto the spool and the other cable unwinds from the spool simultaneously upon rotation of the handle, a dial plate disposed adjacent the handle, and the dial plate and handle having cooperating interfitting means for detachable engagement at spaced positions corresponding to the number of different voltages.

* * * * *